United States Patent [19]

Klüttermann

[11] Patent Number: 4,815,171

[45] Date of Patent: Mar. 28, 1989

[54] SLIVER COILER FOR A CARDING MACHINE

[75] Inventor: Jürgen Klüttermann, Mönchengladbach, Fed. Rep. of Germany

[73] Assignee: Trützschler GmbH & Co. KG, Mönchengladbach, Fed. Rep. of Germany

[21] Appl. No.: 92,687

[22] Filed: Sep. 3, 1987

[30] Foreign Application Priority Data

Sep. 11, 1986 [DE] Fed. Rep. of Germany ..... 3630941

[51] Int. Cl.[4] ..... B65H 54/76; B65H 54/80

[52] U.S. Cl. ..... 19/159 R

[58] Field of Search ..... 19/159 R

[56] References Cited

U.S. PATENT DOCUMENTS

| | | | |
|---|---|---|---|
| 3,035,313 | 5/1962 | Naegeli et al. | 19/288 |
| 3,377,665 | 4/1968 | Kincaid | 19/159 R |
| 4,208,762 | 6/1980 | Starling | 19/159 R |
| 4,283,814 | 8/1981 | Ford et al. | 19/159 R |
| 4,318,206 | 3/1982 | Ferri et al. | 19/159 R |

FOREIGN PATENT DOCUMENTS

| | | |
|---|---|---|
| 1859997 | 7/1962 | Fed. Rep. of Germany . |
| 2353889 | 5/1975 | Fed. Rep. of Germany . |
| 2721422 | 11/1978 | Fed. Rep. of Germany . |
| 3434228 | 3/1986 | Fed. Rep. of Germany . |
| 3517060 | 11/1986 | Fed. Rep. of Germany . |
| 3517058 | 11/1986 | Fed. Rep. of Germany . |
| 8000981 | 5/1980 | PCT Int'l Appl. . |
| 1164917 | 9/1969 | United Kingdom . |
| 2177727 | 1/1987 | United Kingdom . |

*Primary Examiner*—Louis K. Rimrodt

*Attorney, Agent, or Firm*—Spencer & Frank

[57] ABSTRACT

A sliver coiler includes a coiling mechanism; a hood covering a top part of the coiling mechanism; a stationary sliver trumpet mounted in the roof of the hood; an air inlet opening provided in the roof and a suction device connected to the hood and arranged for communicating with an inner space of the hood.

8 Claims, 2 Drawing Sheets

FIG. 3
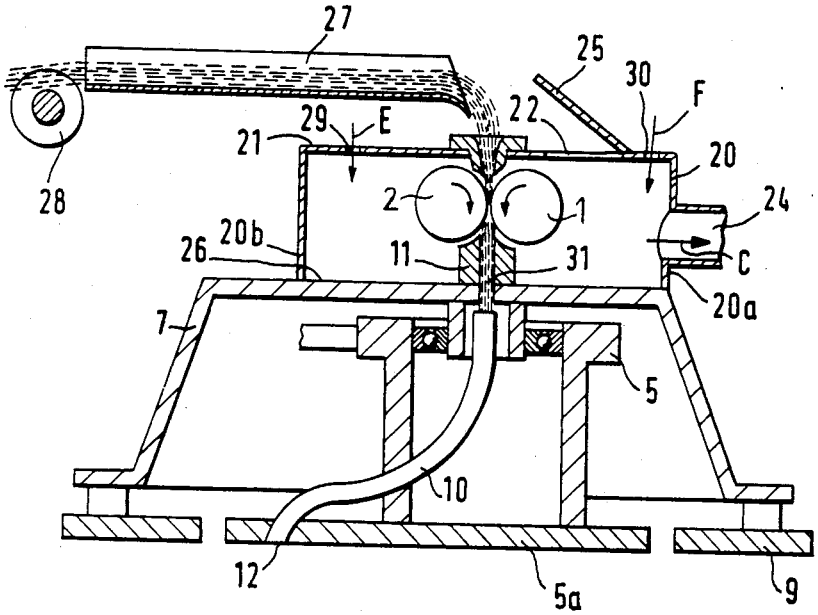
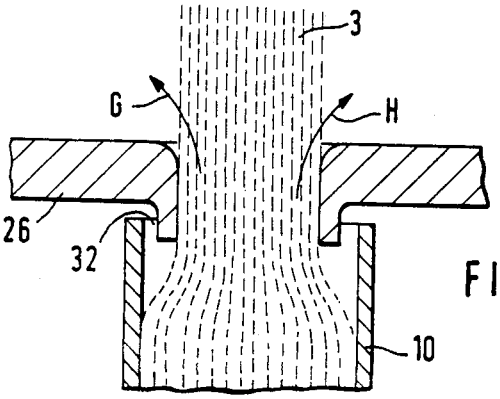
FIG. 4

SLIVER COILER FOR A CARDING MACHINE

CROSS-REFERENCE TO RELATED PATENT

U.S. Pat. No. 4,691,413 (Jürgen Klüttermann) issued on Sept. 8, 1987 pertains to related subject matter.

BACKGROUND OF THE INVENTION

This relates to a sliver coiler in which the sliver discharged by a carding machine is introduced into a stationary trumpet arranged in a roof of a hood which extends over a zone of the sliver coiling mechanism proper.

In a known apparatus as disclosed in German Offenlegungsschrift (non-examined published patent application) No. 1,510,428, the sliver delivered by two feed rollers is withdrawn through the trumpet by calender rollers and deposited into a coiler can by passing the sliver through a sliver channel (sliver guide tube) of a rotary head. Above the feed rollers a closure is situated, and above the sliver coiler device proper, between the closure and the hood a lateral opening is arranged. On its path from the feed rollers to the sliver trumpet the sliver passes through the opening and generates, particularly at high sliver speeds, an air stream in the direction of motion, that is, an air stream towards the sliver trumpet. As a result, no air is introduced from the outside through the opening into the space underneath the closure and the hood. It is a disadvantage of this arrangement that underneath the hood dust accumulates which settles on machine components and on the sliver and thus has an adverse effect on the sliver and the sliver coiling operation. It is a further disadvantage of this prior art arrangement that on the roof of the hood, particularly underneath the sliver and in the zone of the sliver trumpet, dust accumulates which in introduced into the blow room.

SUMMARY OF THE INVENTION

It is an object of the invention to provide an improved apparatus of the above-outlined type from which the discussed disadvantages are eliminated and in which particularly the roof of the hood in the region of the sliver and the space underneath the hood are maintained dust-free.

This object and others to become apparent as the specification progresses, are accomplished by the invention, according to which, briefly stated, in the roof of the hood there is provided at least one air inlet opening and further, a suction device is coupled to the hood.

By virtue of the air inlet opening in the hood in combination with a suction device attached thereto, the regions above and below the hood are maintained dust-free. By means of the air inlet opening the dust which accumulates on the roof, particularly underneath the sliver and in the region of the sliver trumpet is drawn into the inner space of the hood. Therefrom the dust, together with the dust which is released underneath the hood, particularly in the zone of the calender rollers and the inlet opening in the sliver guide tube, is removed by the suction device.

According to a preferred feature of the invention, the air intake opening is located in the zone of the sliver trumpet. By virtue of such an arrangement, the dust flowing in reverse through the sliver trumpet upon deflection of the sliver is removed. According to another advantageous feature of the invention, above the sliver trumpet and the air inlet opening a common closure is provided. In this manner, a limited space is exposed to suction and the suction air is guided in an oriented manner. Preferably, in the roof or a side wall of the hood additional air inlet openings are provided for the introduction of additional air by means of which the condition of air underneath the hood may be regulated.

According to a further advantageous feature of the invention, a pressure roller pair (calender rollers) and a rotatable sliver guide tube are arranged downstream of the sliver trumpet, as viewed in the direction of sliver run. Preferably, between the pressure roller pair and the sliver guide tube a floor of the hood is situated. In this manner, a space is provided which is not exposed to the air stream generated by the rotating sliver guide tube because the space is situated above the floor. In the space there are situated the pressure rollers and in the upper zone the outlet of the sliver trumpet is located. Preferably, the hood floor has a sliver passage which has a smaller passage area than that of the inlet opening of the sliver guide tube. By virtue of this arrangement the sliver is introduced into the sliver guide tube in a "shingled" manner, that is, it is first narrow and then has a widening configuration. At the narrow location dust-laden air flows back into the space underneath the hood whereupon such dust-laden air is drawn away by suction. Expediently, upstream of the sliver trumpet there is arranged at least one support device on which the running sliver lies so that a guidance of the sliver and an oriented air removal by suction are achieved.

BRIEF DESCRIPTION OF THE DRAWING

FIG. 3 is a sectional elevational view of a modification of the structure of FIG. 2.

FIG. 4 is a sectional side elevational view of an enlarged detail of FIG. 3.

DESCRIPTION OF THE PREFERRED EMBODIMENTS

Figure 1:
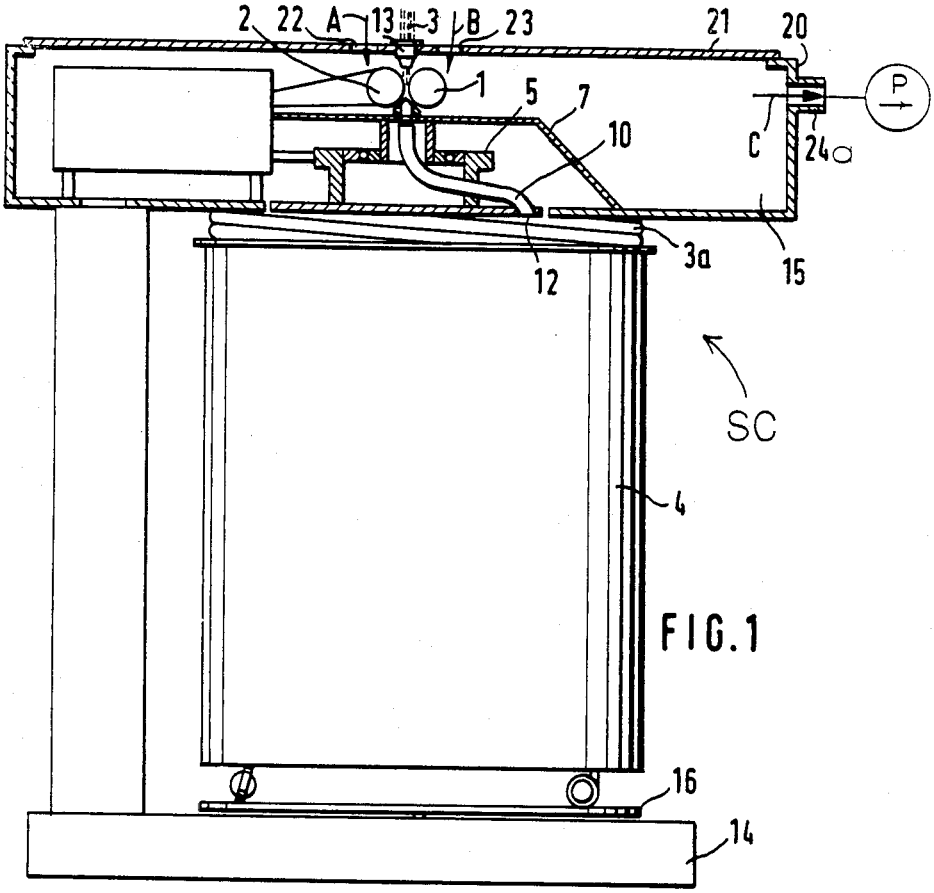
FIG. 1 is a schematic side elevational view of a sliver coiler incorporating the invention.

Turning to FIG. 1, there is shown a sliver coiler, generally designated at SC, including a coiler can 4. The sliver 3 is advanced by cooperating pressure rollers 1 and 2 associated with a fiber processing machine, not shown in detail. Such machine may be a card or a drawing frame for short or long-stapled fiber material and the sliver coiler serves such a machine by depositing the produced sliver into the underlying coiler can. The stationary pressure rollers 1 and 2 rotating about a horizontal axis advance the sliver 3 with a high speed of up to 1000 m/min, for example, over 300 m/min, at which speed the sliver 3 is to be deposited in well-defined coils in the coiler can 4 which rotates during the coiling operation.

A rotary head 5 (rotary plate) forming part of the coiling mechanism proper is supported by means of roller bearings in a carrier 7 for rotation about a vertical axis. The carrier 7 is stationarily held by securing devices attaching it to the machine frame. In the rotary head 5 there is arranged a rotary sliver guide tube 10, upstream of which there is arranged a guide block 11 oriented coaxially with the rotary axis of the rotary head 5 and functioning as an inlet opening for the sliver guide tube 10. The latter extends obliquely downwardly and terminates in an outlet opening 12 provided in the base 5*a* of the rotary head 5, in the vicinity of the base periphery. The sliver guide tube 10 has a curved configuration. Upstream of the pressure rollers 1 and 2 there is provided a stationary sliver trumpet 13.

The machine frame for the sliver coiler comprises an elongated base plate 14 and a head plate 15. These two horizontally extending plate components 14 and 15 are in a vertically superposed, spaced relationship. The underside of the base 5*a* of the rotary head 5 is essentially coplanar with the underside 9 of the head plate 15. During normal operation of the sliver coiler the pressure rollers (feed rollers) 1, 2 and the coiler head 5 are rotated, so that the sliver 3 is fed into the rotating sliver guide tube 10 and is discharged downwardly in coils as the sliver guide tube outlet 12 orbits about the axis of the rotary head 5. The sliver coils are deposited in offset, overlapping layers as the can 4 rotates. For this purpose, the base plate 14 has a rotary base platform 16 which supports the can 4 and which is rotated when the sliver 3 is deposited in the can 4 as it is being discharged by the outlet opening 12 of the sliver conduit 10. After the can 4 is full, the fiber material projects upwardly beyond the top edge of the can 4, whereby the deposited fiber material, by virtue of the inherent elasticity of the sliver 3 and/or by virtue of an upwardly urged can base (not shown) is pressed against the undersides of the head plate 15 and the rotary head base 5*a*.

The sliver 3 is introduced into the stationary sliver trumpet 13 which is situated in a roof 21 of a hood 20 which, in turn, extends over a region of the sliver coiler. In the roof 21 two air inlet openings 22 and 23 are provided which are situated in the vicinity of the sliver trumpet 13. The arrows A and B indicate the direction of air flow into the inner space of the hood 20 through the air inlet openings 22, 23. Further, the side wall 20*a* of the hood 20 has a suction outlet 24*a* coupled to an only symbolically shown suction device 24. The arrow C indicates the dust-laden air stream flowing from the inner space of the hood 20 into the suction device 24.

Figure 2:
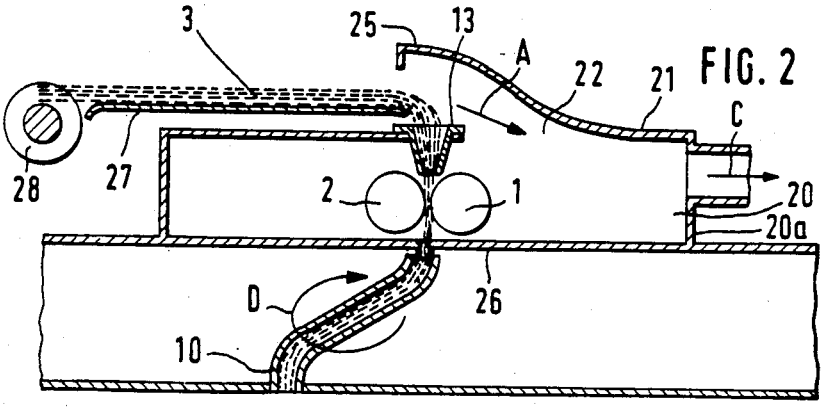
FIG. 2 is a schematic side elevational view of one part of the structure shown in FIG. 1, illustrating further details.

In FIG. 2, above the sliver trumpet 13 and the air inlet opening 22 there is provided a common closure 25 which is slightly curved for aerodynamic reasons and which is open on one side in the direction of the incoming sliver 3. At its other side, the closure 25 merges into the roof 21 of the hood 20. Downstream of the sliver trumpet 13 there is arranged the pressure roller pair 1, 2 and the sliver guide tube 10 which rotates in the direction of the arrow D. Between the pressure roller pair 1, 2 and the sliver guide tube 10 there is provided a floor 26 of the hood 20. Upstream of the sliver trumpet 13 there are provided a stationary trough 27 and a rotary roller 28 which constitute supports for the sliver 3 as it runs in a generally horizontal orientation.

Turning now to FIG. 3, in the roof 21 of the hood 20 two additional air inlet openings 29, 30 are provided which are arranged at a distance from the air inlet opening 22 and are smaller than the latter. Arrows E and F indicate the direction of air flow through the openings 29, 30. The floor 26 has a silver passage 31 which has a smaller passage area than that of the inlet opening 32 in the sliver guide tube 10, as particularly well illustrated in FIG. 4. The sliver 3 is, as it passes through the opening 31, slightly compressed so that air escapes from the sliver 3 as illustrated by arrows G and H. These air streams flow backwardly into the inner space of the hood 20 and are removed therefrom by the suction device 24 as illustrated in FIG. 3. The sliver slightly widens in the sliver guide tube 10.

Within the hood 20 which is formed by roof 21, the floor 26 and the side walls 20*a* and 20*b* as well as a frontal and rear wall (neither shown), the pressure roller pair 1, 2 is exposed to suction. Also, upon exit of the sliver 3 from the sliver trumpet 13, the released dust is removed by the suction device 24.

It will be understood that the above description of the present invention is susceptible to various modifications, changes and adaptations, and the same are intended to be comprehended within the meaning and range of equivalents of the appended claims.

What is claimed is:

1. In a sliver coiler including a coiling mechanism; a hood covering a top part of the coiling mechanism; said hood having a roof; a stationary sliver trumpet mounted in said roof; a pressure roller pair supported stationarily within said hood downstream of said sliver trumpet as viewed in a direction of sliver run through said trumpet and a rotatably supported sliver guide tube situated downstream of said pressure roller pair; the improvement comprising (a) an air inlet opening provided in said roof;

(b) a suction device connected to said hood and arranged for communicating with an inner space of said hood;

(c) a floor forming part of said hood and separating said pressure roller pair from said silver guide tube; and (d) means defining a sliver passage in said floor; said sliver passage being traversed by the sliver as it runs from said pressure roller pair to said sliver guide tube.

2. A sliver coiler as defined in claim 1, wherein said air inlet opening is situated adjacent said sliver trumpet.

3. A sliver coiler as defined in claim 1, further comprising a common closure attached to said hood and situated above said sliver trumpet and said air inlet opening.

4. A sliver coiler as defined in claim 1, further comprising additional air inlet openings in said hood

5. A sliver coiler as defined in claim 4, wherein said additional air inlet openings are provided in said roof.

6. A sliver coiler as defined in claim 4, wherein said hood has side walls; said additional air inlet openings are provided in at least one of said side walls.

7. A sliver coiler as defined in claim 1, further wherein said sliver guide tube has a sliver inlet opening; said sliver passage having a cross-sectional area smaller than that of said sliver inlet opening.

8. A sliver coiler as defined in claim 1, further comprising a sliver supporting means situated upstream of said sliver trumpet.

* * * * *